US007975809B2

(12) United States Patent
Aardse

(10) Patent No.: US 7,975,809 B2
(45) Date of Patent: Jul. 12, 2011

(54) METHOD AND ARRANGEMENT FOR PREVENTING DISTURBING NOISE CAUSED BY THE COUNTERWEIGHT OF AN ELEVATOR

(75) Inventor: Rodney Aardse, Rotterdam (NL)

(73) Assignee: Kone Corporation, Helsinki (FI)

( * ) Notice: Subject to any disclaimer, the term of this patent is extended or adjusted under 35 U.S.C. 154(b) by 165 days.

(21) Appl. No.: 12/334,352

(22) Filed: Dec. 12, 2008

(65) Prior Publication Data

US 2009/0120732 A1 May 14, 2009

Related U.S. Application Data

(63) Continuation of application No. PCT/FI2007/000169, filed on Jun. 14, 2007.

(30) Foreign Application Priority Data

Jun. 15, 2006 (FI) ..... 20060595

(51) Int. Cl.
*B66B 7/12* (2006.01)

(52) U.S. Cl. ..... 187/405; 187/404

(58) Field of Classification Search ..... 187/404, 187/405
See application file for complete search history.

(56) References Cited

U.S. PATENT DOCUMENTS

| | | | | |
|---|---|---|---|---|
| 2,322,774 | A * | 6/1943 | Polack | 187/254 |
| 7,175,201 | B2 * | 2/2007 | Childs et al. | 280/759 |

FOREIGN PATENT DOCUMENTS

| | | | |
|---|---|---|---|
| JP | 7-315725 | A | 12/1995 |
| JP | 9-110339 | A | 4/1997 |
| JP | 11-335038 | * | 12/1999 |
| JP | 2000-309481 | A | 11/2000 |
| JP | 2005-15136 | A | 1/2005 |

* cited by examiner

*Primary Examiner* — Thomas J Brahan
(74) *Attorney, Agent, or Firm* — Birch, Stewart, Kolasch & Birch, LLP

(57) ABSTRACT

The invention relates to a method and an arrangement for preventing disturbing noise caused by the counterweight of an elevator. At first temporary tightening means (8), e.g. slings provided with tightening elements (9), are fitted and tightened around the counterweight (1). After this the actual tightening means (10), e.g. steel belts, are fitted and tightened around the counterweight (1), after which the slings are removed.

14 Claims, 2 Drawing Sheets

Figure 1:
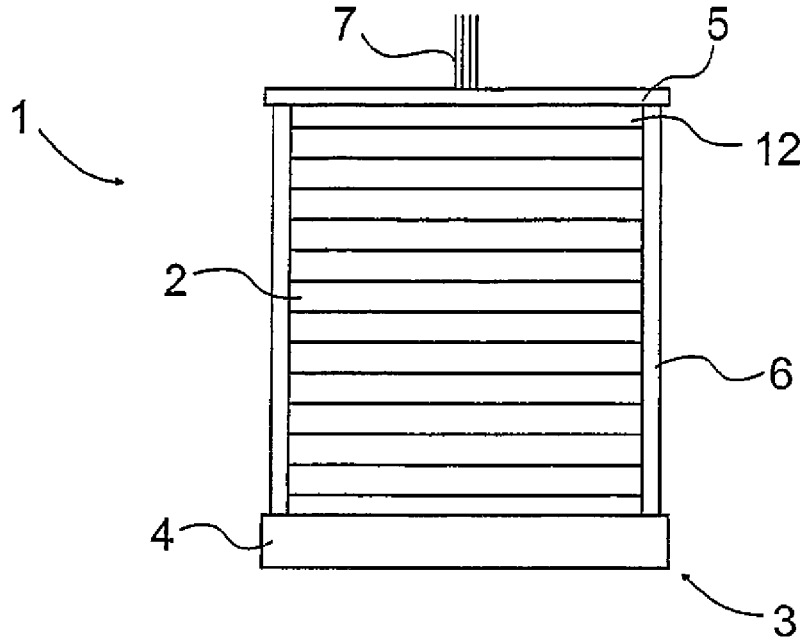

METHOD AND ARRANGEMENT FOR PREVENTING DISTURBING NOISE CAUSED BY THE COUNTERWEIGHT OF AN ELEVATOR

This application is a Continuation of copending PCT International Application No. PCT/FI2007/000169 filed on Jun. 14, 2007, which designated the United States, and on which priority is claimed under 35 U.S.C. §120. This application also claims priority under 35 U.S.C. §119(a) on Patent Application No(s). 20060595 filed in Finland on Jun. 15, 2006, all of which are hereby expressly incorporated by reference into the present application.

The present invention relates to a method as presented in the preamble of claim 1 and an arrangement as presented in the preamble of claim 7 for preventing disturbing noise caused by the counterweight of an elevator.

The counterweights used in elevators are often manufactured of different weight elements, which have been integrated into a single counterweight. The weight elements are of some suitable material, such as concrete or steel, that is heavy in terms of its mass. By using weight elements the counterweight can easily be made to the desired weight, when a suitable quantity of elements are e.g. stacked one on top of the other. The weight of the counterweight can easily be adjusted after installation also by adding or removing elements. The weight elements are generally stacked one on top of the other inside some kind of frame, to the top part of which frame the roping of the elevator is fixed. Some prior-art solutions are disclosed in JP-patents 7315725, 09110339 and 2005015136.

A problem of these types of solutions is however that often that the weight elements of the counterweight rattle against each other and against the frame and thus cause disturbing noise, which can be heard inside the elevator car and on the floors of the building.

One prior-art solution is disclosed in JP-patent 200309481. In this solution also the weight elements of the counterweight can rattle against each other and cause noise.

The purpose of this invention is to eliminate the aforementioned drawbacks and to achieve a simple and inexpensive method and arrangement for preventing disturbing noise caused by the counterweight of an elevator. The method according to the invention is characterized by what is disclosed in the characterization part of claim 1. Similarly the arrangement of the invention is characterized by what is disclosed in the characterization part of claim 7. Other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments.

One advantage of the method and arrangement according to the invention is that disturbing noises caused by the counterweight of the elevator are prevented, in which case excessive noise disturbance is not heard in the elevator car or on the landings. Another advantage is that the method and arrangement are simple and inexpensive to implement and reliable to use.

Figure 2:
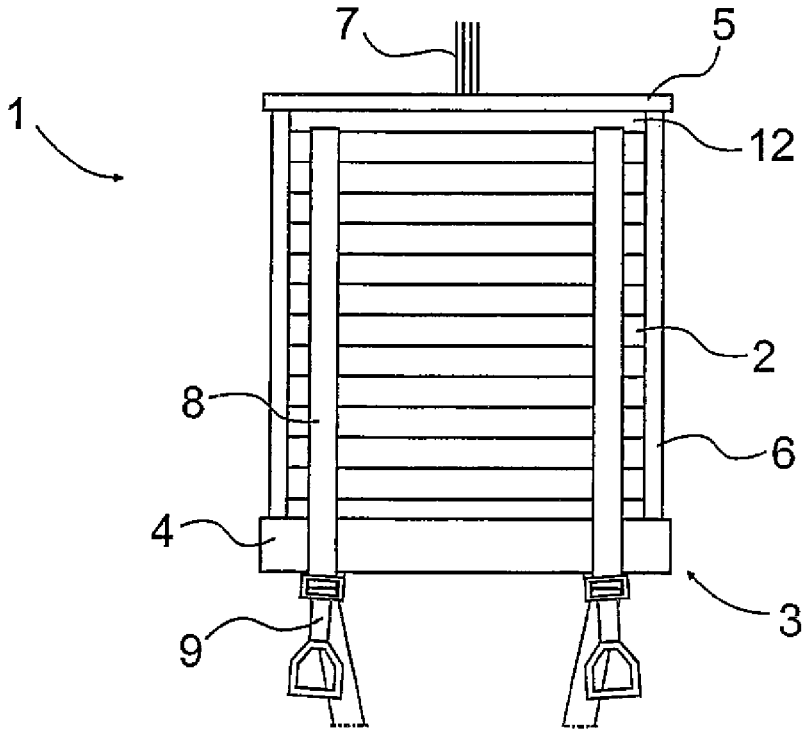
Figure 3:
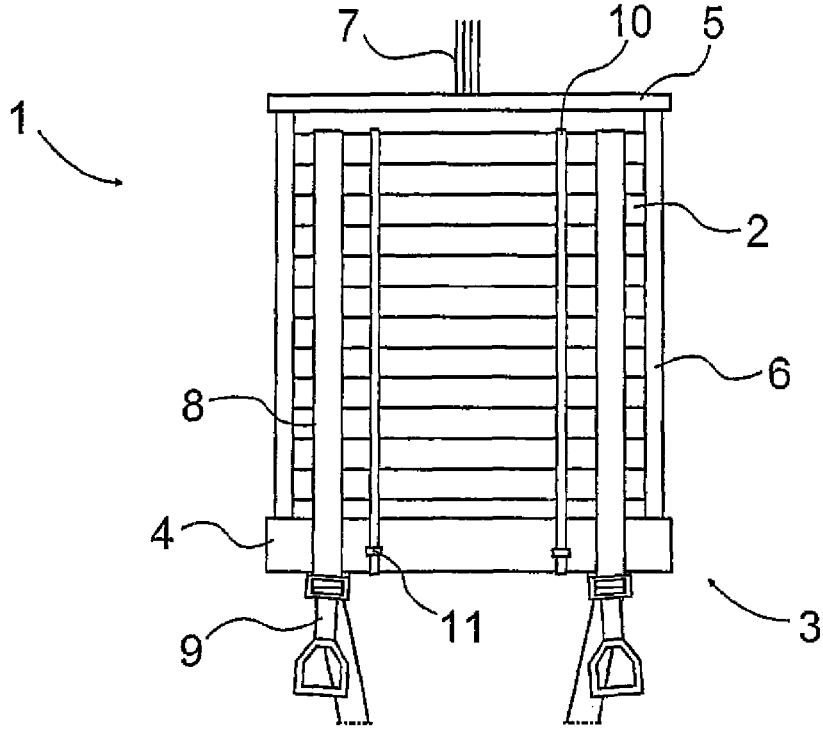
Figure 4:
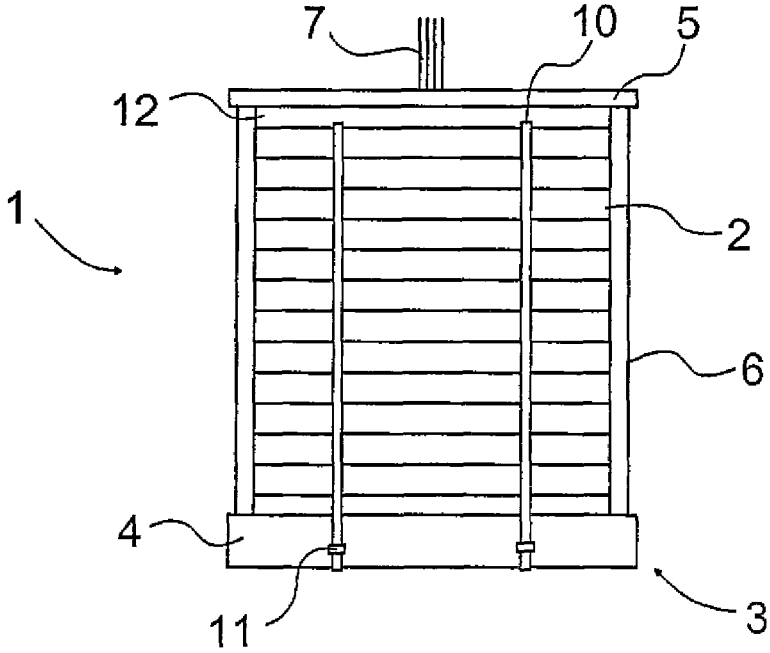

In the following, the invention will be described in more detail by the aid of one of its embodiments with reference to the attached drawings, wherein FIG. 1 presents a simplified front view of the counterweight of an elevator before tightening of the weight elements, FIG. 2 presents a simplified front view of the counterweight of an elevator and the first phase of the method according to the invention, FIG. 3 presents a simplified front view of the counterweight of an elevator and the second phase of the method according to the invention and FIG. 4 presents a simplified front view of the counterweight of an elevator and the third phase of the method according to the invention.

FIG. 1 presents one counterweight of an elevator as viewed from the front. The counterweight 1 is assembled by stacking one on top of the other the desired quantity of weight elements 2, which are fitted in connection with the frame 3. The weight elements 2 are preferably disposed inside the frame 3, in which case the frame 3 supports and binds the weight elements 2 around the weight elements 2. The weight elements 2 are stacked on top of the lower support 4 of the frame and the upper support 5 of the frame is fitted above the weight elements 2. The lower support 4 and the upper support 5 are e.g. metal beams with an essentially U-shaped cross-section, which beams are open e.g. towards each other, in other words in the direction of the weight elements 2. The lower support 4 and the upper support 5 are joined at both their ends with side supports 6 forming the perimeter-like frame 3 of the counterweight. The lower support 4 and the upper support 5 are joined to the side supports 6 with e.g. a screw fastening, which is not shown in the figures. The side supports 6 are also e.g. metal beams with an essentially U-shaped cross-section, which beams are open e.g. towards each other, in other words in the direction of the weight elements 2. The ends of the weight elements 2 are threaded inside the side supports 6 e.g. before fixing the upper support 5 to the side supports 6. The hoisting roping 7 is fixed to the upper support 5 of the frame 3 of the counterweight 1.

The parts of the counterweight are often standard elements, so they can be used as such in different types of elevators, in which case the weight of the counterweight needed can vary according to the need at the time. From this it follows that the number of weight elements 2 is not always the same, in which case a gap 12 often remains between the upper support 5 and the topmost weight element. In this case without additional tightening the weight elements 2 are able to move to some extent inside the frame 3 and they can cause disturbing noise when they touch each other and the frame 3. This noise problem is solved with the method and the arrangement according to the invention by binding the separate weight elements tightly against each other.

FIG. 2 presents substantially strap-like slings 8 acting as temporary tightening means, which slings according to the method of the invention are at first fitted around the counterweight 1 and tightened to be tight with the tightening elements 9 of the slings 8. The slings 8 are passed through the gap 12 over the topmost weight element 2 at the top and under the lower support 4 of the frame 3 at the bottom, in which case the weight elements 2 are tightened both against each other and against the lower support 4.

FIG. 3 presents a situation in which the slings 8 are tightened around the counterweight 1 in the manner of FIG. 2 as are also the essentially band-like actual tightening means 10, which are e.g. ordinary steel belts, which are generally used around different packagings and boxes. The tightening means 10 are tightened and locked to be tight via their locking elements 11 with a tightening appliance suited to the purpose. The tightening means 10 are passed through the gap 12 over the topmost weight element 2 at the top and under the lower support 4 of the frame 3 at the bottom in the manner of the slings 8, in which case the weight elements 2 are tightened both against each other and against the lower support 4.

FIG. 4 presents a situation in which the tightening means 10 presented in FIG. 3 are fitted around the counterweight 1 and the slings 8 that were temporary tightening means have been removed. The actual tightening means 10 now hold the counterweight 1 tightly together, and the weight elements 2 no longer cause disturbing noise by rattling against each other and/or against the frame 3.

With the method according to the invention the disturbing noises caused by the counterweight are prevented e.g. as follows: At least one, preferably two slings 8 are fitted in the vertical direction around at least the weight elements 2 of the counterweight 1 and the lower support 4 near the edges of the counterweight 1. After this the slings 8 are tightened to be as tight as possible around the counterweight 1 by using the tightening elements 9 incorporated in the slings 8 such that the slings 8 tighten at least the weight elements 2 of the counterweight 1 tightly against each other and also the bottommost weight element against the lower support 4. After this at least one, preferably two, actual tightening means 10, which are e.g. ordinary steel belts used in different packagings, are fitted around the weight elements 2 of the counterweight 1 and the lower support 4 in the vertical direction. The tightening means 10 are tightened to be as tight as possible around the weight elements 2 of the counterweight 1 and the lower support 4 by means of their locking elements 11 using a tightening appliance suited to the purpose such that the tightening means 10 tighten at least the weight elements 2 of the counterweight 1 tightly against each other and also the bottommost weight element against the lower support 4. Finally the slings are removed from around the counterweight 1, in which case the actual tightening means 10 hold the counterweight 1 and its weight elements 2 tightly packaged together.

It is obvious to the person skilled in the art that the invention is not limited solely to the examples described above, but that it may be varied within the scope of the claims presented below. Thus for example the counterweight can be tightened temporarily with some other appliance suited to the purpose instead of with slings, such as with a hydraulic press.

It is also obvious to the person skilled in the art that depending on the construction the slings and the actual tightening means can also be disposed around the upper support of the counterweight, in which case the weight elements are pressed to be tight between the upper support and the lower support of the counterweight.

It is further obvious to the person skilled in the art that instead of steel belts it is possible to use some other means suited to the purpose as tightening means, such as e.g. bands made of some other material or tightening means tightened with screws.

The invention claimed is:

1. A method for preventing disturbing noise caused by a counterweight of an elevator, the counterweight comprising a frame and a plurality of separate weight elements arranged in a stack and fitted within the frame, the method comprising:

providing at least one temporary tightening device wound around and firmly tightening at least the plurality of separate weight elements such that the plurality of separate weight elements contact and bear against each other;

after the plurality of separate weight elements are tightened by the at least one temporary tightening device, providing at least an actual tightening member wound around and firmly tightening at least the plurality of separate weight elements; and after the plurality of separate weight elements are tightened by both the at least one temporary tightening device and the at least one actual tightening device, removing the at least one temporary tightening device.

2. The method according to claim 1, wherein the temporary tightening device is a strap-shaped sling.

3. The method according to claim 2, wherein the actual tightening device is a band-shaped steel belt.

4. The method according to claim 2, wherein the temporary tightening device and the actual tightening device are wound around and tighten the weight elements and a lower support of the frame such that the plurality of separate weight elements and the lower support of the frame contact and bear against each other.

5. The method according to claim 1, wherein the actual tightening device is a band-shaped steel belt.

6. The method according to claim 5, wherein the temporary tightening device and the actual tightening device are wound around and tighten the weight elements and a lower support of the frame such that the plurality of separate weight elements and the lower support of the frame contact and bear against each other.

7. The method according to claim 1, wherein the temporary tightening device and the actual tightening device are wound around and tighten the weight elements and a lower support of the frame such that the plurality of separate weight elements and the lower support of the frame contact and bear against each other.

8. The method according to claim 1 further comprising:

connecting the counterweight to the elevator; and operating the elevator after the step of removing the at least one temporary tightening device.

9. A system for preventing disturbing noise caused by a counterweight of an elevator, the system comprising:

the counterweight comprising a frame and a plurality of separate weight elements arranged in a stack and fitted within the frame;

a rope configured to connect the counterweight to the elevator;

an actual tightening device configured to be wound around and firmly tighten at least the plurality of separate weight elements such that the plurality of separate weight elements contact and bear against each other; and a temporary tightening device configured to be wound around and firmly tighten at least the plurality of separate weight elements such that the plurality of separate weight elements contact and bear against each other, wherein said temporary tightening device only tightens at least the plurality of separate weight elements prior to the actual tightening device tightening the same, and after the plurality of separate weight elements are tightened firmly by the actual tightening device, the temporary tightening device is removed from the counterweight.

10. The system according to claim 9, wherein the actual tightening device is a steel belt provided with one or more locking elements.

11. The system according to claim 10, wherein the temporary tightening device and the actual tightening device are configured to be wound around and tighten the weight elements and a lower support of the frame such that the plurality of separate weight elements and the lower support of the frame contact and bear against each other.

12. The system according to claim 9, wherein the temporary tightening device and the actual tightening device are configured to be wound around and tighten the weight elements and a lower support of the frame such that the plurality of separate weight elements and the lower support of the frame contact and bear against each other.

13. The system according to claim 12, wherein the temporary tightening device is a strap-shaped sling.

14. The system according to claim 9 further comprising an elevator connected to the counterweight through a rope, wherein when the elevator is operated, the counterweight is only provided with the actual temporary tightening device.

* * * * *